US011370080B2

(12) United States Patent
Kobayashi et al.

(10) Patent No.: US 11,370,080 B2
(45) Date of Patent: Jun. 28, 2022

(54) POLISHING HEAD FOR HOLDING SUBSTRATE AND SUBSTRATE PROCESSING APPARATUS

(71) Applicant: EBARA CORPORATION, Tokyo (JP)

(72) Inventors: Kenichi Kobayashi, Tokyo (JP); Makoto Kashiwagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/821,281

(22) Filed: Mar. 17, 2020

(65) Prior Publication Data

US 2020/0306924 A1 Oct. 1, 2020

(51) Int. Cl.
*B24B 37/32* (2012.01)

(52) U.S. Cl.
CPC ..... *B24B 37/32* (2013.01)

(58) Field of Classification Search
CPC ..... B24B 37/27; B24B 37/28; B24B 37/30; B24B 37/32; B24B 37/04; B24B 37/042; B25B 13/065
USPC ..... 451/285, 397, 398, 5, 8, 9, 10
See application file for complete search history.

(56) References Cited

U.S. PATENT DOCUMENTS 5,092,203 A * 3/1992 Mader ..... B25B 13/08 81/119
5,452,905 A * 9/1995 Bohmer ..... H01L 21/6838 269/21
6,079,299 A * 6/2000 Sundstrom ..... B25B 13/04 81/121.1
6,755,719 B2 * 6/2004 Yoshida ..... B24B 19/226 451/10
6,790,129 B2 * 9/2004 Moriya ..... B24B 37/042 430/5
7,122,280 B2 * 10/2006 Moriya ..... G03F 1/60 430/5
7,585,205 B2 * 9/2009 Katsuoka ..... B24B 37/04 451/11
7,976,362 B2 * 7/2011 Katsuoka ..... B24B 55/02 451/285
8,967,608 B2 * 3/2015 Mitsumori ..... H01L 21/67748 269/289 R
9,368,371 B2 * 6/2016 Oh ..... B24B 37/32
9,718,170 B2 * 8/2017 Eggert ..... B25B 13/065
(Continued)

FOREIGN PATENT DOCUMENTS

JP 11-099471 A 4/1999
JP 2000-094308 A 4/2000
(Continued)

*Primary Examiner* — Joseph J Hail
*Assistant Examiner* — Jonathan R Zaworski
(74) *Attorney, Agent, or Firm* — BakerHostetler

(57) ABSTRACT

To reduce a risk generated at a time of collision of a substrate with a retainer. According to one embodiment, a head for holding a polygonal substrate as a polishing object of a polishing apparatus is provided. The head includes a substrate holding surface configured to hold a substrate and a retainer positioned outside the substrate holding surface. The retainer has an end region. The end region is arranged adjacent to a corner portion of the substrate held onto the head. The end region has an end surface on a side of the substrate holding surface. The end surface is configured to increase in distance from the substrate holding surface with approaching an end portion in a longitudinal direction of the retainer.

9 Claims, 9 Drawing Sheets

(56) References Cited

U.S. PATENT DOCUMENTS

| | | | | |
|---|---|---|---|---|
| 10,442,059 | B2 * | 10/2019 | Milligan | B25B 13/06 |
| 10,500,695 | B2 * | 12/2019 | Reedy | B24B 37/32 |
| 2003/0031890 | A1 * | 2/2003 | Moriya | H01L 21/30625 428/620 |
| 2003/0036340 | A1 * | 2/2003 | Moriya | B24B 37/042 430/5 |
| 2009/0029627 | A1 * | 1/2009 | Ejimatani | B24B 9/065 451/5 |
| 2009/0311945 | A1 * | 12/2009 | Strasser | B24B 37/32 451/8 |
| 2012/0183683 | A1 * | 7/2012 | Mitsumori | C23C 14/50 427/162 |
| 2016/0082569 | A1 * | 3/2016 | Bae | B24B 37/32 451/288 |
| 2019/0134776 | A1 * | 5/2019 | Nakanishi | B24B 41/068 |
| 2020/0130131 | A1 * | 4/2020 | Togawa | B24B 37/32 |

FOREIGN PATENT DOCUMENTS

| | | | | |
|---|---|---|---|---|
| JP | 2003048149 | A | * | 2/2003 |
| JP | 2018-183820 | A | | 11/2018 |

* cited by examiner

POLISHING HEAD FOR HOLDING SUBSTRATE AND SUBSTRATE PROCESSING APPARATUS

TECHNICAL FIELD

This application relates to a polishing head for holding a substrate, and a substrate processing apparatus. This application claims priority from Japanese Patent Application No. 2019-067207 filed on Mar. 29, 2019. The entire disclosure including the descriptions, the claims, the drawings, and the abstracts in Japanese Patent Application No. 2019-067207 filed on Mar. 29, 2019 is herein incorporated by reference.

BACKGROUND ART

In production of a semiconductor device, a chemical mechanical polishing (CMP) apparatus is used for flattening a surface of a substrate. The substrate used in the production of the semiconductor device has a circular-plate shape in many cases. There is also a growing demand for a flatness when flattening a surface of a quadrangle substrate of a Copper Clad Laminate substrate (CCL substrate), a Printed Circuit Board (PCB) substrate, a photomask substrate, a display panel, and the like, not limited to the semiconductor device. There is also a growing demand for flattening a surface of a package substrate on which an electronic device such as the PCB substrate is arranged.

CITATION LIST

PTL 1: Japanese Unexamined Patent Application Publication No. 2018-183820

PTL 2: Japanese Unexamined Patent Application Publication No. 2000-94308

PTL 3: Japanese Unexamined Patent Application Publication No. 11-99471

SUMMARY OF INVENTION

Technical Problem

A circular semiconductor substrate has a dimension determined by a standard (for example, the SEMI standard), while the above-described quadrangle substrate of the Copper Clad Laminate substrate (CCL substrate), the Printed Circuit Board (PCB) substrate, the photomask substrate, the display panel, and the like has a dimension that is not determined by a standard and the like, thus possibly including substrates having various dimensions. Recently, the dimension of the substrate tends to increase in terms of production efficiency for the device. A large and heavy substrate is likely to cause warp and deformation. Thus, a technique similar to that of a processing apparatus for the conventional circular substrate is not necessarily applicable to the large and heavy substrate.

Generally, a CMP apparatus includes a polishing head for holding a substrate and a table for holding the polishing pad. When the substrate is polished, the substrate held onto the polishing head is pressed to the polishing pad on the table, and the polishing head holding the substrate and the table holding the polishing pad are each rotated to relatively move the substrate and the polishing pad, thus polishing the substrate. The polishing head includes a retainer for avoiding the substrate from jumping out of the polishing head while the polishing head is rotating. The retainer can avoid the substrate from jumping out of the polishing head to some extent, but the substrate may move inside the polishing head while the polishing head is rotating to collide with the retainer. Depending on the dimension and the weight of substrate, when the substrate collides with the retainer, the substrate may be damaged, thus having a risk that breaks the substrate. Depending on the dimension and the weight of substrate, when the substrate collides with the retainer, there is also a risk that the substrate jumps out of the polishing head. One purpose of this application is to reduce a risk when a substrate collides with a retainer.

Solution to Problem

According to one embodiment, a head for holding a polygonal substrate as a polishing object of a polishing apparatus is provided. The head includes a substrate holding surface configured to hold a substrate and a retainer positioned outside the substrate holding surface. The retainer has an end region. The end region is arranged adjacent to a corner portion of the substrate held onto the head. The end region has an end surface on a side of the substrate holding surface. The end surface is configured to increase in distance from the substrate holding surface with approaching an end portion in a longitudinal direction of the retainer.

DESCRIPTION OF EMBODIMENTS

Figure 1:
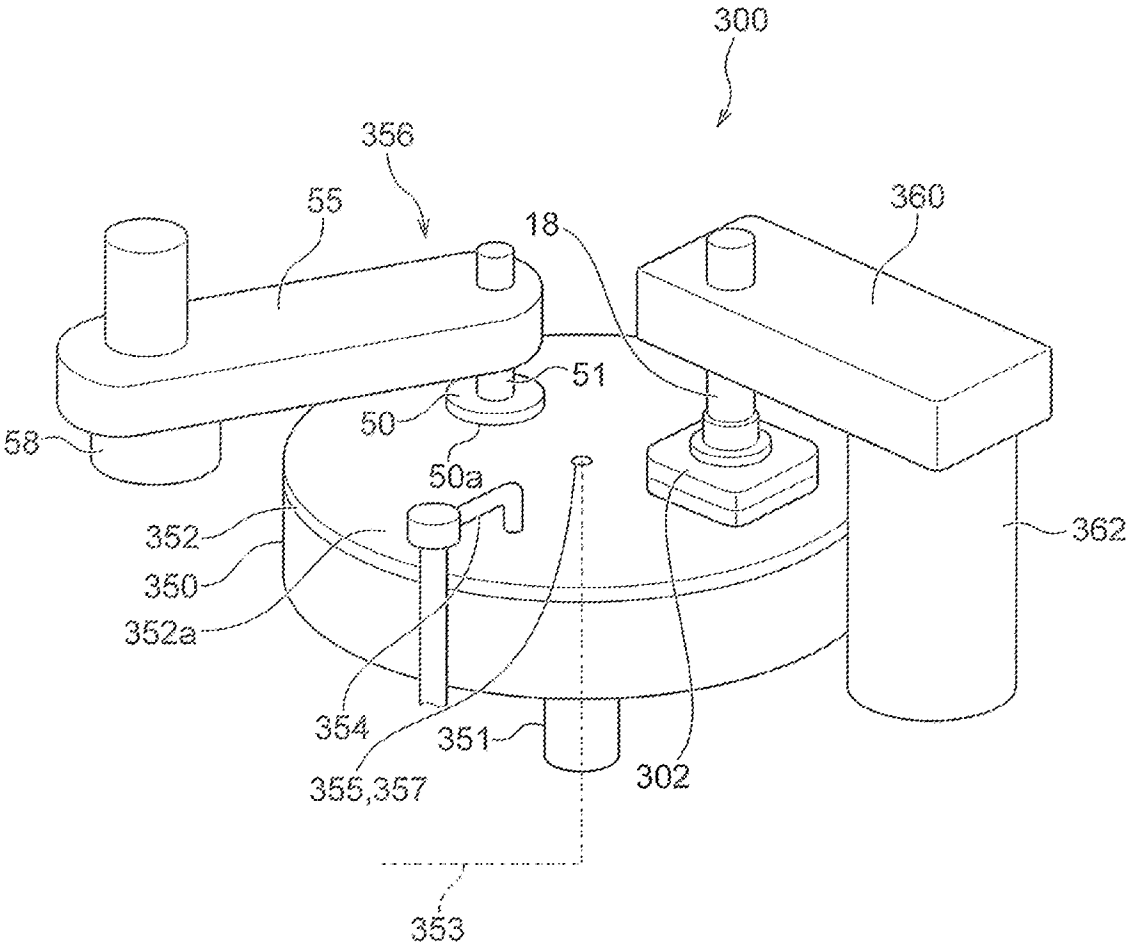
FIG. 1 is a perspective view schematically illustrating a configuration of a substrate polishing apparatus as a substrate processing apparatus, according to one embodiment.

The following describes embodiments of a polishing head and a substrate processing apparatus including the polishing head according to the present invention with the attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another.

FIG. 1 is a perspective view schematically illustrating a configuration of a substrate polishing apparatus as a substrate processing apparatus according to one embodiment. A polishing apparatus 300 illustrated in FIG. 1 includes a polishing table 350 and a polishing head 302. The polishing head 302 holds a substrate as a polishing object and presses it to a polishing surface on the polishing table 350. The polishing table 350 is coupled to a polishing-table rotation motor (not illustrated) arranged below it via a table shaft 351, thus being rotatable around the table shaft 351. The polishing table 350 has an upper surface on which a polishing pad 352 is stuck. The polishing pad 352 has a surface 352*a* that constitutes the polishing surface that polishes the substrate. In one embodiment, the polishing pad 352 may be stuck via a layer for facilitating peeling from the polishing table 350. Such a layer is, for example, a silicone layer and a fluorine-based resin layer, and, for example, one described in Japanese Unexamined Patent Application Publication No. 2014-176950 and the like may be used.

There are various kinds of polishing pads available in the market, for example, SUBA800 ("SUBA" is a registered trademark), IC-1000, and IC-1000/SUBA400 (two-layer cloth) manufactured by Nitta Haas Incorporated, and Surfin xxx-5, Surfin 000, and the like ("Surfin" is a registered trademark) manufactured by FUJIMI INCORPORATED. SUBA800, Surfin xxx-5, and Surfin 000 are nonwoven fabrics obtained such that fiber is solidified with a urethane resin. IC-1000 is a hard foamed polyurethane (single layer). The foamed polyurethane is porous and has a surface having multiple fine depressions or holes.

A polishing liquid supply nozzle 354 is installed above the polishing table 350. This polishing liquid supply nozzle 354 supplies a polishing liquid onto the polishing pad 352 on the polishing table 350. As illustrated in FIG. 1, a passage 353 for supplying the polishing liquid is provided through the polishing table 350 and the table shaft 351. The passage 353 communicate with an opening portion 355 on the surface of the polishing table 350. The polishing pad 352 has a through-hole 357 at a position corresponding to the opening portion 355 of the polishing table 350. The polishing liquid passing through the passage 353 is supplied onto the surface of the polishing pad 352 from the opening portion 355 of the polishing table 350 and the through-hole 357 of the polishing pad 352. The numbers of the opening portion 355 of the polishing table 350 and the through-hole 357 of the polishing pad 352 may be each one or plural. The positions of the opening portion 355 of the polishing table 350 and the through-hole 357 of the polishing pad 352 are any, but in one embodiment, they are arranged around the center of the polishing table 350.

Although not illustrated in FIG. 1, in one embodiment, the polishing apparatus 300 may include an atomizer for injecting a liquid or a mixture fluid of the liquid and a gas toward the polishing pad 352. The liquid injected from the atomizer is, for example, a pure water, and the gas is, for example, a nitrogen gas.

The polishing head 302 is connected to a shaft 18. This shaft 18 moves up and down with respect to a swing arm 360 with an up-and-down motion mechanism. This up-and-down motion of the shaft 18 moves the whole polishing head 302 up and down and positions it with respect to the swing arm 360. The shaft 18 rotates with driving of a rotation motor (not illustrated). The rotation of the shaft 18 rotates the polishing head 302 centering on the shaft 18.

The polishing head 302 has a lower surface configured to hold a quadrangle substrate. The swing arm 360 is configured turnable centering on a spindle 362. The polishing head 302 is configured movable between a substrate delivery and receipt position and above the polishing table 350 with the turn of the swing arm 360. Moving down the shaft 18 moves down the polishing head 302 to allow the substrate to be pressed to the surface (the polishing surface) 352*a* of the polishing pad 352. At this time, the polishing head 302 and the polishing table 350 are each rotated, and the polishing liquid is supplied onto the polishing pad 352 from the polishing liquid supply nozzle 354 provided above the polishing table 350 and/or from the opening portion 355 provided to the polishing table 350. Thus, the substrate can be pressed to the polishing surface 352*a* of the polishing pad 352 to polish a surface of the substrate. During polishing of a substrate WF, the arm 360 may be fixed or swung so that the polishing head 302 passes through the center of the polishing pad 352 (covers the through-hole 357 of the polishing pad 352).

The polishing apparatus 300 according to one embodiment includes a dressing unit 356 that dresses the polishing surface 352*a* of the polishing pad 352. This dressing unit 356 includes a dresser 50 brought into sliding contact with the polishing surface 352*a*, a dresser shaft 51 coupled to the dresser 50, and a swing arm 55 that rotatably supports the dresser shaft 51. The dresser 50 has a lower portion configured from a dressing member 50*a*. This dressing member 50*a* has a lower surface to which needle-shaped diamond particles are attached.

The swing arm 55 is configured to turn centering on a spindle 58 by being driven by a motor (not illustrated). The dresser shaft 51 rotates with the driving of the motor (not illustrated). This rotation of the dresser shaft 51 rotates the dresser 50 around the dresser shaft 51. The dresser shaft 51 is configured movable up and down. The dresser 50 is moved up and down via the dresser shaft 51, and the dresser 50 can be pressed to the polishing surface 352*a* of the polishing pad 352 with a predetermined pressing force.

The dressing for the polishing surface 352*a* of the polishing pad 352 is performed as follows. The dresser 50 is pressed to the polishing surface 352*a* by an air cylinder or the like, and simultaneously, the pure water is supplied to the polishing surface 352*a* from a pure-water supply nozzle (not illustrated). In this state, the dresser 50 rotates around the dresser shaft 51 to bring the lower surface (diamond particles) of the dressing member 50*a* into sliding contact with the polishing surface 352*a*. Thus, the dresser 50 scrapes off the polishing pad 352 to dress the polishing surface 352*a*.

Figure 2:
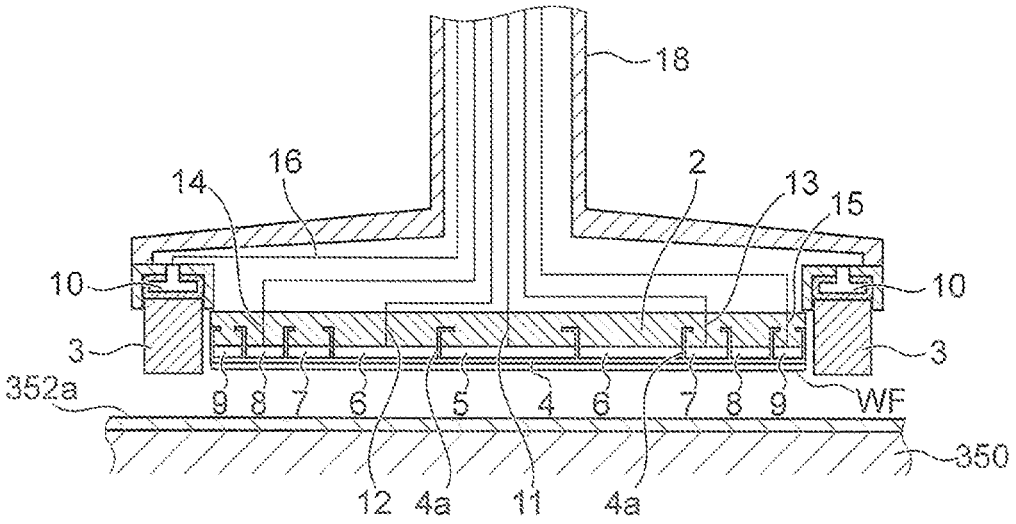
FIG. 2 is a schematic cross-sectional view of a polishing head, according to one embodiment.
Figure 3:
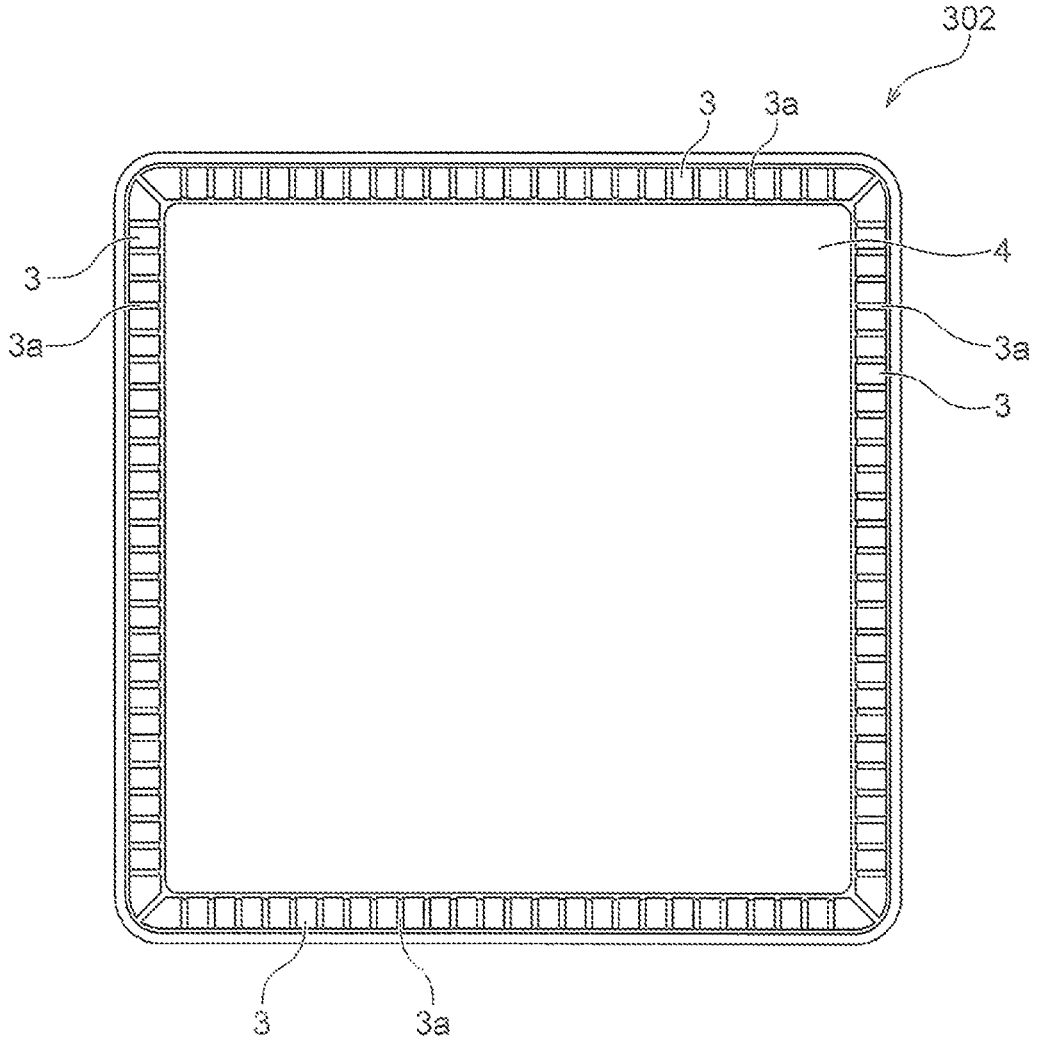
FIG. 3 is a drawing that the polishing head is viewed from a polishing table side, according to one embodiment.

FIG. 2 is a schematic cross-sectional view of the polishing head 302, according to one embodiment. FIG. 2 schematically illustrates only main components that constitute the polishing head 302. FIG. 3 is a view when the polishing head 302 is viewed from a side of the polishing table 350, according to one embodiment.

As illustrated in FIG. 2, the polishing head 302 includes a main body 2, which presses the substrate WF to the polishing surface 352*a*, and retainer members 3, which directly press the polishing surface 352*a*. The main body 2 is formed of a roughly quadrangle tabular member. The retainer members 3 are mounted outside the main body 2. In one embodiment, the retainer member 3 is an elongate rectangular plate-shaped member as illustrated in FIG. 3. In the embodiment illustrated in FIG. 3, as the retainer members 3, four plate-shaped members are disposed outside respective sides of the quadrangle main body 2 of the polishing head 302. In one embodiment, as illustrated in FIG. 3, the retainer member 3 has a plurality of grooves 3*a*. The retainer member 3 illustrated in FIG. 3 has the grooves 3*a* extending from inside to outside of the polishing head 302. In the retainer member 3 illustrated in FIG. 3, an end portion of the elongate retainer member 3 has a circular sector. Therefore, as illustrated in FIG. 3, four retainer members 3 are combined, thus surrounding the approximately whole including corner portions of the main body 2 of the polishing head 302 with the retainer members 3. The main body 2 is made of a metal such as a stainless steel (SUS) or a resin such as an engineering plastic (for example, PEEK). The main body 2 has a lower surface on which an elastic film (membrane) 4 that contacts a back surface of the substrate is mounted. In one embodiment, the elastic film (membrane) 4 is made of a rubber material having excellent strength and durability such as an ethylene propylene rubber (EPDM), a polyurethane rubber, and a silicon rubber. In one embodiment, the elastic film (membrane) 4 can be made of the rubber material using a mold. The main body 2 may be configured by combining a plurality of members.

As illustrated in FIG. 2, the elastic film (membrane) 4 has a plurality of concentric partition walls 4*a*. These partition walls 4*a* form a circular center chamber 5, a quadrangle annular ripple chamber 6 surrounding the center chamber 5, a quadrangle annular middle chamber 7 surrounding the ripple chamber 6, a quadrangle annular outer chamber 8 surrounding the middle chamber 7, and a quadrangle annular edge chamber 9 surrounding the outer chamber 8 between an upper surface of the elastic film 4 and the lower surface of the main body 2. That is, the center chamber 5 is formed on a center portion of the main body 2, and the ripple chamber 6, the middle chamber 7, the outer chamber 8, and the edge chamber 9 are concentrically formed sequentially from the center to an outer peripheral direction. As illustrated in FIG. 2, the main body 2 internally has a flow passage 11 communicated with the center chamber 5, a flow passage 12 communicated with the ripple chamber 6, a flow passage 13 communicated with the middle chamber 7, a flow passage 14 communicated with the outer chamber 8, and a flow passage 15 communicated with the edge chamber 9 respectively. The flow passage 11 communicated with the center chamber 5, the flow passage 12 communicated with the ripple chamber 6, the flow passage 13 communicated with the middle chamber 7, the flow passage 14 communicated with the outer chamber 8, and the flow passage 15 communicated with the edge chamber 9 are connected to a fluid supply source and/or a vacuum source via a rotary joint. A retainer member pressurization chamber 10 made of an elastic film is also formed on the retainer member 3. The retainer member pressurization chamber 10 is connected to the fluid supply source and/or the vacuum source via a flow passage 16 and the rotary joint formed in the main body 2 of the polishing head 302.

In the polishing head 302 configured as illustrated in FIG. 2, as described above, the center chamber 5 is formed on the center portion of the main body 2, and the ripple chamber 6, the middle chamber 7, the outer chamber 8, and the edge chamber 9 are concentrically formed sequentially from the center to the outer peripheral direction. It is possible to independently adjust respective fluid pressures supplied to these center chamber 5, ripple chamber 6, middle chamber 7, outer chamber 8, and edge chamber 9, and the retainer member pressurization chamber 10. With such a structure, a pressing force for pressing the substrate WF to the polishing pad 352 can be adjusted for each region of the substrate WF, and a pressing force with which the retainer member 3 presses the polishing pad 352 can be adjusted. The elastic film 4 may have a plurality of vacuum suction holes for causing the substrate WF to be vacuum-suctioned to the polishing head 302.

Figure 4:
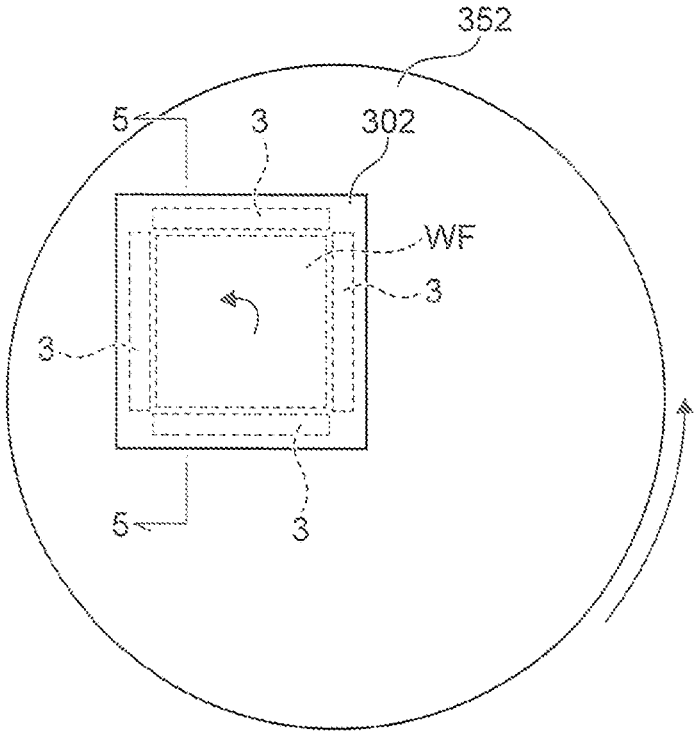
FIG. 4 is a top view schematically illustrating a view of a substrate WF being polished by pressing the substrate WF held onto the polishing head to a polishing pad on the polishing table while rotating the polishing head and the polishing table, according to one embodiment.
Figure 5:
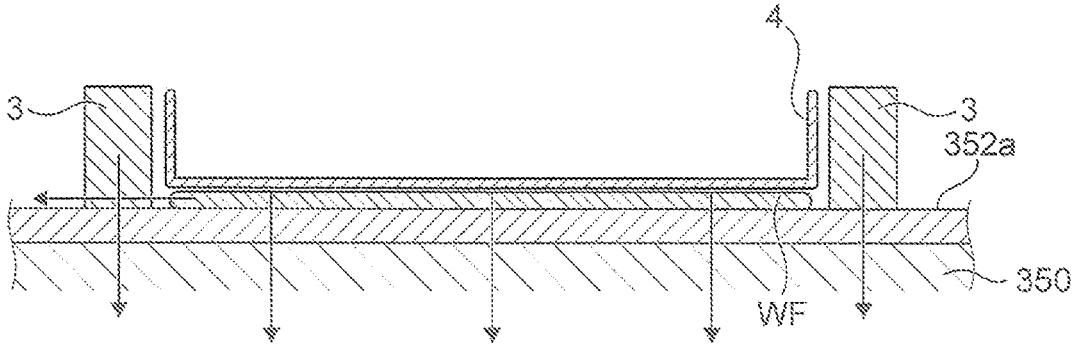
FIG. 5 is a cross-sectional view schematically illustrating a cross section viewed from a direction of an arrow 5 in FIG. 4.

FIG. 4 is a top view schematically illustrating a view of the substrate WF is being polished by pressing the substrate WF held onto the polishing head 302 to the polishing pad 352 on the polishing table 350 while rotating the polishing head 302 and the polishing table 350, according to one embodiment. In FIG. 4, the retainer member 3 and the substrate WF are indicated by dashed lines. FIG. 5 is a cross-sectional view schematically illustrating a cross section viewed from a direction of an arrow 5 in FIG. 4. As illustrated in FIG. 4, the polishing pad 352 and the substrate WF are rotating. Thus, a force acts on the substrate WF in a planar direction with a friction force between the substrate WF and the polishing pad 352. In FIG. 5, a force acting on the substrate WF in a horizontal direction, a force provided to the substrate WF from the elastic film 4 in a downward direction, and a force provided to the retainer member 3 in the downward direction are indicated by arrows. During the polishing of the substrate WF, the force is also provided to the retainer member 3 in the downward direction by supplying the retainer member pressurization chamber 10 with the fluid. Therefore, the retainer member 3 avoids the substrate WF from jumping out of the polishing head 302.

Figure 6:
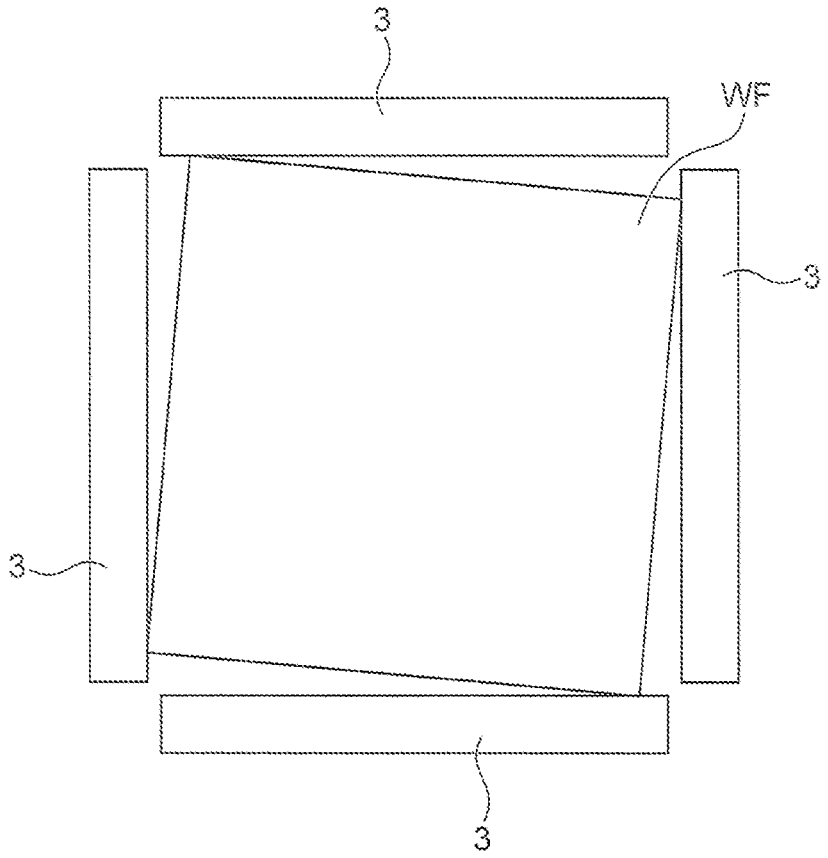
FIG. 6 is a bottom view schematically illustrating a state where a state during the polishing of the substrate WF is viewed from a side of the polishing pad, according to one embodiment.

FIG. 6 is a bottom view schematically illustrating a state where a state during the polishing of the substrate WF is viewed from a side of the polishing pad 352, according to one embodiment. As described above, the force acts on the substrate WF in the planar direction during the polishing. Thus, as illustrated in FIG. 6, the substrate WF may move inside a region surrounded by the retainer members 3 to cause the substrate WF to collide with the retainer members 3. As illustrated in the drawing, when the substrate WF is quadrangle, the corner portion of the substrate WF may collide with the retainer member 3, thus locally providing a large force to the retainer member 3 and the substrate WF. Depending on a dimension and a weight of the substrate WF, a very large force may be generated by the collision, thus damaging the substrate WF and the retainer member 3 and in some cases, breaking the substrate WF and the retainer member 3. The substrate WF held onto the polishing head 302 may slip through between the retainer member 3 and the polishing pad 352 to jump out of the polishing head 302.

Figure 7:
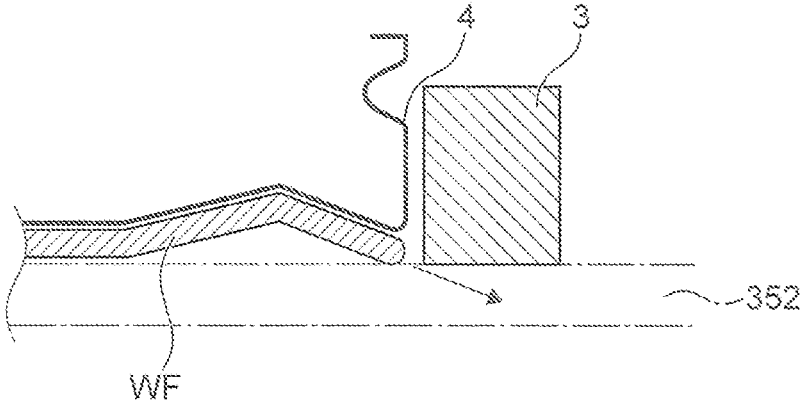
FIG. 7 is a cross-sectional view schematically illustrating a case where a damage occurs on the substrate WF.

FIG. 7 is a cross-sectional view schematically illustrating a case where a damage occurs on the substrate WF. As illustrated in FIG. 7, during the polishing of the substrate WF, the force acts on the substrate WF in the planar direction to possibly generate buckling on the substrate WF. When the buckling is generated on the substrate WF, the substrate WF may fracture. When the substrate WF fractures, a part of the fractured substrate may get through between the retainer member 3 and the elastic film 4 to damage any components including the elastic film 4 arranged inside the polishing head 302. Even when the buckling does not fracture the substrate WF, as illustrated in FIG. 7, the substrate WF bends to possibly generate a force in the downward direction on an end portion of the substrate WF, thus causing the substrate WF to get through between the retainer member 3 and the polishing pad 352 to jump out of the polishing head 302.

As one solution to avoid the damage to the substrate WF and the retainer member 3 caused by the collision of the substrate WF with the retainer member 3 as described above, it is thought to decrease a gap between the retainer member 3 and the substrate WF. The small gap between the retainer member 3 and the substrate WF decreases an impact when the substrate WF collides with the retainer member 3. However, the small gap between the retainer member 3 and the substrate WF makes it difficult to cause the polishing head 302 to hold the substrate WF. Generally, in the substrate polishing apparatus, when the polishing head 302 is caused to hold the substrate WF, the substrate WF is arranged at a predetermined position, and the polishing head 302 is moved above the substrate WF to hold the substrate WF at the predetermined position surrounded by the retainer member 3 by a method such as the vacuum suction. The small gap between the retainer member 3 and the substrate WF needs a high accuracy for positioning the polishing head when the substrate WF is handed over to the polishing head 302. Therefore, the polishing head 302 has a complicated moving mechanism, thus increasing a production cost.

Increasing a pressing pressure of the retainer member 3 to the polishing pad 352 during the polishing can avoid the substrate WF from jumping out of the polishing head 302. However, the pressing pressure of the retainer member 3 influences a polishing rate. Thus, it is not possible to increase the pressing pressure of the retainer member 3 from only the aspect to avoid the substrate WF from jumping out of the polishing head 302. For example, the increased pressing pressure of the retainer member 3 decreases the polishing rate near the retainer member 3, thus being possibly incapable of uniformly polishing the substrate WF.

Figure 8:
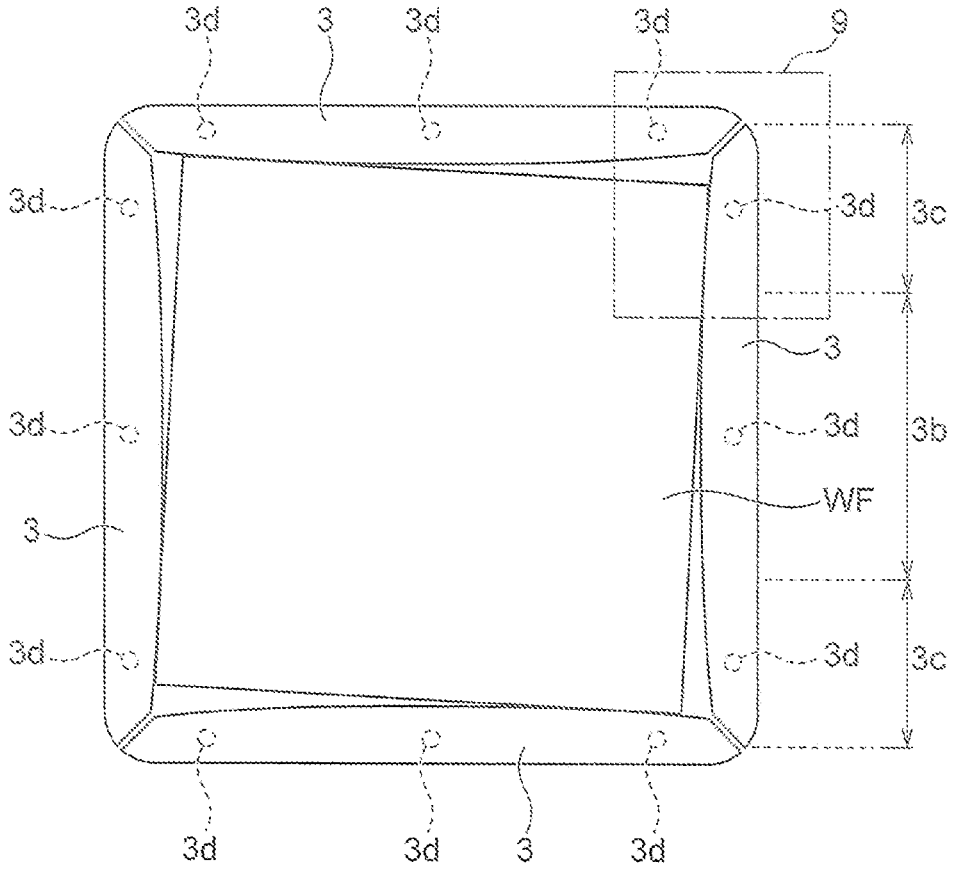
FIG. 8 is a bottom view schematically illustrating a state during the polishing of the substrate is viewed from a side of the polishing pad, according to one embodiment.
Figure 9:
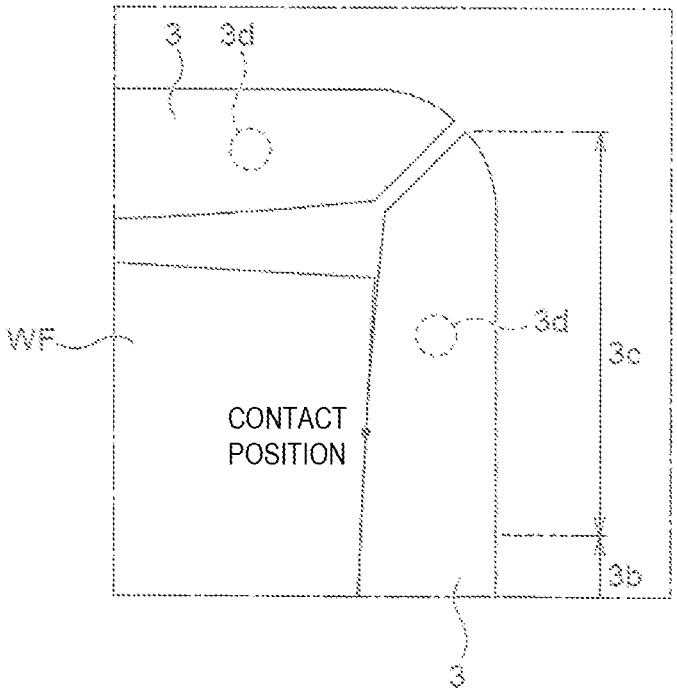
FIG. 9 is an enlarged view of a region indicated by a reference numeral 9 in FIG. 8.

This disclosure provides the retainer member that can solve or reduce at least a part of the above-described problem. FIG. 8 is a bottom view schematically illustrating a state where a state during the polishing of the substrate WF is viewed from the polishing pad 352 side, according to one embodiment. FIG. 9 is an enlarged view of a region indicated by a reference numeral 9 in FIG. 8. In the embodiment illustrated in FIG. 8, the retainer member 3 is an elongate approximately rectangular plate-shaped member. In the embodiment illustrated in FIG. 8, as the retainer members 3, four plate-shaped members are disposed outside respective sides of the quadrangle main body 2 of the polishing head 302. Each retainer member 3 illustrated in FIG. 8 has a central region 3*b* and end regions 3*c*. The central region 3*b* is a predetermined region including the center in a longitudinal direction of the retainer member 3. The end regions 3*c*, which are regions arranged on outsides in the longitudinal direction from the central region 3*b* of the retainer member 3, are positioned on both sides of the central region 3*b*. The end region 3*c* of the retainer member 3 is positioned adjacent to the corner portion of the substrate WF held onto the polishing head 302. The end region 3*c* has an end surface on a side of the substrate WF. This end surface is configured to increase in distance from the substrate WF with approaching the end portion in the longitudinal direction of the retainer member 3.

In the embodiment illustrated in FIGS. 8 and 9, the central region 3*b* of the retainer member 3 has a straight part. The end region 3*c* of the retainer member 3 has a curved part. The straight part of the retainer member 3 is a part where a side opposed to the substrate WF is straight. The straight part of the central region 3*b* extends parallel to an opposing side of the substrate WF accurately held onto the polishing head 302. The curved part of the retainer member 3 is a part where a side opposed to the substrate WF is curved. The curved part of the retainer member 3 is positioned adjacent to the corner portion of the substrate WF held onto the polishing head 302. The retainer member 3 has a dimension in a thickness direction (a direction perpendicular to the papers in FIGS. 8 and 9). Thus, one opposed to the substrate WF is actually a two-dimensional "surface" not one-dimensional "line" and "side." However, in this description, as described above, it is described as "straight part" and "curved part."

FIGS. 8 and 9 schematically illustrate a state where the substrate WF rotates inside the polishing head 302 during the polishing to collide with the retainer members 3. The retainer member 3 in this embodiment has the curved parts adjacent to the corner portions of the substrate WF. Thus, the corner portion of the substrate WF does not contact the retainer member 3. Conversely, the curved parts of the retainer member 3 are provided such that the corner portion of the substrate WF does not contact the retainer member 3 even when the substrate WF rotates inside the polishing head 302. In the polishing head 302 including the retainer member 3 according to this embodiment, the corner portion of the substrate WF does not collide with the retainer member 3. Thus, it is possible to avoid the large force from being locally applied to the corner portion of the substrate WF to reduce a risk that damages the substrate WF and the retainer member 3. A risk that the substrate WF jumps out of the polishing head 302 during the polishing also can be reduced.

The retainer member 3 according to this embodiment has the straight part. Thus, when the substrate WF linearly moves inside the polishing head 302 in a state where the straight part of the central region 3*b* is parallel to the adjacent side of the substrate WF, the side of the substrate WF contacts the straight part of the retainer member 3. Therefore, the large force is not locally applied with the substrate WF and the retainer member 3.

The curved part in the retainer member 3 according to the embodiment illustrated in FIGS. 8 and 9 can have any shape insofar as the corner portion of the substrate WF does not contact the retainer member 3. For example, the curved part can have a circular arc shape. As one example, the curved part may be a part of a circular arc having a curvature radius equal to or more than a dimension in the longitudinal direction of the retainer member 3.

The retainer member 3 according to the embodiment illustrated in FIGS. 8 and 9 may be configured to have the grooves 3*a* as illustrated in FIG. 3.

Figure 10:
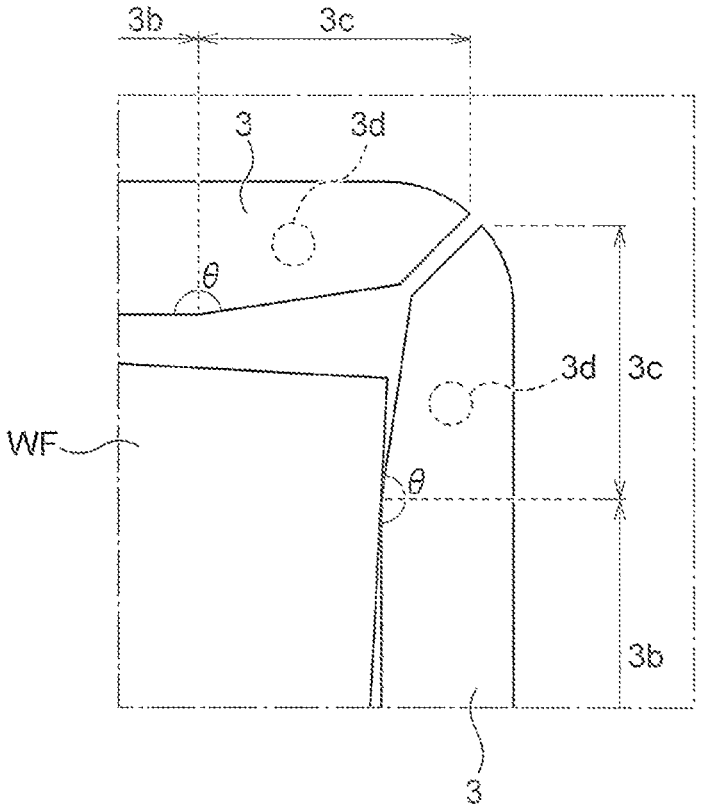
FIG. 10 is a drawing illustrating around an end portion of a retainer member, according to one embodiment.

FIG. 10 is a drawing illustrating around the end portion of the retainer member 3 according to one embodiment. In the embodiment illustrated in FIG. 10, the retainer member 3 has the central region 3*b* and the end region 3*c* similarly to the retainer member 3 illustrated in FIGS. 8 and 9. In the embodiment illustrated in FIG. 10, the central region 3*b* has a straight part, and the end region 3*c* also has a straight part. As illustrated in FIG. 10, the straight part of the central region 3*b* and the straight part of the end region 3*c* has an obtuse angle θ. The retainer member 3 according to the embodiment illustrated in FIG. 10 has an effect similar to that of the retainer member 3 having the curved part illustrated in FIGS. 8 and 9. In the embodiment illustrated in FIG. 10, a part where the straight part of the central region 3*b* and the straight part of the end region 3*c* are combined having the obtuse angle θ is preferably chamfered without a corner, and especially preferably roundly chamfered. The retainer member 3 according to the embodiment illustrated in FIG. 10 may be configured to have the grooves 3*a* as illustrated in FIG. 3.

The retainer member 3 according to one embodiment has a positioning feature 3*d* for positioning the retainer member 3 inside the polishing head 302. The positioning feature 3*d* can be a depressed portion formed on the retainer member 3. A depressed portion is also provided to a predetermined position of the main body 2 of the polishing head 302, and a positioning pin is arranged at the depressed portion 3*d* of the retainer member 3 and the depressed portion of the main body 2 of the polishing head 302, thus ensuring the positioning of the retainer member 3 at the predetermined position of the polishing head 302. At least one of the positioning features 3*d* of the retainer member 3 is preferably provided to the end region 3*c*. When the substrate WF rotates inside the polishing head 302 and the substrate WF contacts the retainer member 3 during the polishing, it is preferably configured such that a contact position is on a side of the central region 3*b* of the retainer member 3 with respect to the positioning feature 3*d*. The positioning feature 3*d* of the retainer member 3 may be provided to not only the end region 3*c* but also the central region 3*b*. A plurality of positioning features 3*d* may be provided at regular intervals. Alternatively, a plurality of positioning features 3*d* may be provided in any arrangement.

Figure 11:
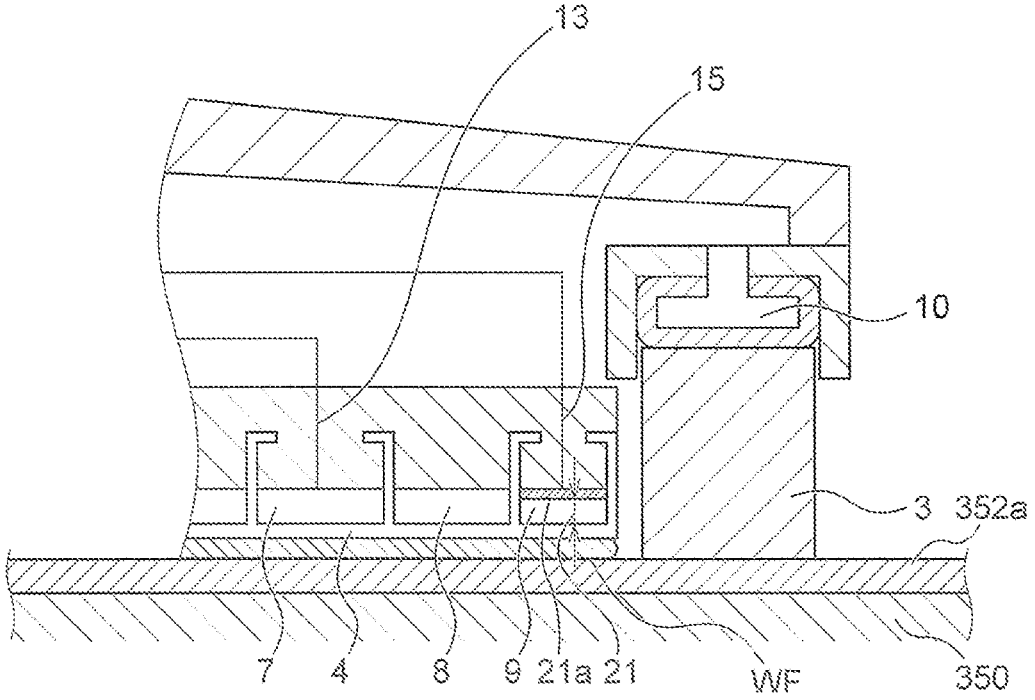
FIG. 11 is a cross-sectional view schematically illustrating around the retainer member of the polishing head, according to one embodiment.

FIG. 11 is a cross-sectional view schematically illustrating around the retainer member 3 of the polishing head 302 according to one embodiment. The polishing head 302 illustrated in FIG. 11 can have a configuration mostly similar to that of the polishing head 302 illustrated in FIG. 2. However, in the polishing head 302 according to the embodiment illustrated in FIG. 11, it is configured such that a height 21 of a pressure chamber positioned at an outermost formed of the elastic film 4 that holds the substrate WF is small. In the polishing head 302 illustrated in FIG. 11, the chamber positioned at the outermost is the edge chamber 9. Thus, the height 21 of the edge chamber 9 is configured to be small. The height 21 of the pressure chamber is a dimension a direction perpendicular to the substrate WF of the pressure chamber in a condition (for example, an atmospheric pressure) where a pressure in the pressure chamber is identical to a pressure outside the pressure chamber. The height 21 of the pressure chamber is small in an outermost region of the elastic film 4 that holds the substrate WF, thus decreasing a distance between an upper surface 21*a* of the pressure chamber and the polishing surface 352*a* of the polishing pad 352. Therefore, when the substrate WF contacts the retainer member 3 during the polishing, the buckling of the substrate WF as illustrated in FIG. 7 can be reduced. The reduction in the buckling of the substrate WF during the polishing can reduce the risks of the breakage and the jumping out of the polishing head 302 of the substrate WF. The height 21 of the pressure chamber in the outermost region of the elastic film 4 that holds the substrate WF is set to the extent that the buckling of the substrate WF can be reduced.

In the embodiment illustrated in FIG. 11, the height 21 of the edge chamber 9 as the pressure chamber positioned at the outermost is set smaller than that of the other pressure chambers, but heights of all the pressure chambers may be as small as the height of the edge chamber 9. In the embodiment illustrated in FIG. 11, the elastic film 4 forms a plurality of pressure chambers, while only one pressure chamber may be provided, thus making a height of the pressure chamber small as another embodiment. At this time, the height may be small in only an outermost region of the one pressure chamber. Further, in the embodiment illustrated in FIG. 11, the height 21 of the pressure chamber is defined by a distance between the lower surface of the main body 2 of the polishing head 302 and the upper surface of the elastic film 4, while the height 21 of the pressure chamber may be defined by a distance between another rigid body member mounted on the main body 2 of the polishing head 302 and the upper surface of the elastic film 4. The other rigid body member may be, for example, a holder for mounting the elastic film 4 on the main body 2.

The embodiment of the present invention has been described above based on some examples in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

From the above-described embodiments, at least the following technical ideas are obtained.

[Configuration 1]

According to a configuration 1, a head for holding a polygonal substrate as a polishing object of a polishing apparatus is provided. This head includes a substrate holding surface for holding a substrate and a retainer positioned outside the substrate holding surface. The retainer has an end region. The end region is arranged adjacent to a corner portion of the substrate held onto the head. The end region has an end surface on a side of the substrate holding surface. The end surface is configured to increase in distance from the substrate holding surface with approaching an end portion in a longitudinal direction of the retainer.

[Configuration 2]

According to a configuration 2, the head according to the configuration 1 includes a positioning member for positioning the retainer inside the head. The positioning member is positioned in the end region of the retainer when the retainer is viewed perpendicularly from a side of the substrate.

[Configuration 3]

According to a configuration 3, in the head according to the configuration 1 or the configuration 2, the end region of the retainer has a curved part, and the curved part of the retainer is arranged adjacent to the corner portion of the substrate held onto the head.

[Configuration 4]

According to a configuration 4, in the head according to any one configuration of the configuration 1 to the configuration 3, the retainer has a central region, and the end region of the retainer extends from the central region.

[Configuration 5]

According to a configuration 5, the head according to any one configuration of the configuration 1 to the configuration 4 includes a plurality of the retainers. The plurality of respective retainers are arranged along respective sides of the substrate held onto the head.

[Configuration 6]

According to a configuration 6, a polishing apparatus for polishing a polygonal substrate is provided. The polishing apparatus includes a table that holds a polishing pad and the head according to any one configuration of the configuration 1 to the configuration 5. The polishing apparatus is configured to polish the substrate by pressing the substrate held onto the head to the polishing pad and relatively moving the substrate and the polishing pad.

[Configuration 7]

According to a configuration 7, a retainer used for a head for holding a polygonal substrate as a polishing object of a polishing apparatus is provided. This retainer has an end region. The end region is arranged adjacent to a corner portion of the substrate held onto the head. The end region has an end surface on a side of the substrate. The end surface is configured to increase in distance from the substrate with approaching an end portion in a longitudinal direction of the retainer.

[Configuration 8]

According to a configuration 8, in the retainer according to the configuration 7 includes a positioning feature for mounting a positioning member. The positioning member is configured to position the retainer inside the head. The positioning feature is positioned in the end region of the retainer.

[Configuration 9]

According to a configuration 9, in the retainer according to the configuration 7 or the configuration 8, the end region of the retainer has a curved part, and the curved part of the retainer is arranged adjacent to the corner portion of the substrate held onto the head.

[Configuration 10]

According to a configuration 10, in the retainer according to any one configuration of the configuration 7 to the configuration 9, the retainer has a central region, and the end region of the retainer extends from the central region.

[Configuration 11]

According to a configuration 11, in the retainer according to the configuration 10, the central region of the retainer has a straight part, the straight part of the retainer is arranged along a side of the substrate held onto the head.

REFERENCE SIGNS LIST

2 . . . main body
3 . . . retainer member
3*a* . . . groove
3*b* . . . central region
3*c* . . . end region
3*d* . . . positioning feature
4 . . . elastic film
4*a* . . . partition wall
5 . . . center chamber
6 . . . ripple chamber
7 . . . middle chamber
8 . . . outer chamber
9 . . . edge chamber
10 . . . retainer member pressurization chamber
18 . . . shaft
300 . . . polishing apparatus
302 . . . polishing head
350 . . . polishing table
352 . . . polishing pad
352*a* . . . polishing surface
WF . . . substrate

What is claimed is:

1. A head for holding a polygonal substrate as a polishing object of a polishing apparatus, the head comprising:

a substrate holding surface for holding a substrate; and a retainer positioned outside the substrate holding surface, wherein the retainer has an end region, the end region is arranged adjacent to a corner portion of the substrate held onto the head, the end region has an end surface on a side of the substrate holding surface, and the end surface is configured to increase in distance from the substrate holding surface with approaching an end portion in a longitudinal direction of the retainer, wherein the end region of the retainer is configured such that the corner portion of the substrate does not contact the retainer even when the substrate rotates on the substrate holding surface, the end region of the retainer has a curved part, and the curved part of the retainer is arranged adjacent to the corner portion of the substrate held onto the head, the retainer further comprises a positioning feature for positioning the retainer inside the head, wherein the positioning feature is positioned in the curved part of the retainer.

2. The head according to claim 1 comprising:

a positioning member engaged with the positioning feature of the retainer.

3. The head according to claim 1, wherein the retainer has a central region, and the end region of the retainer extends from the central region.

4. The head according to claim 1, comprising:

a plurality of the retainers, wherein the plurality of respective retainers are arranged along respective sides of the substrate held onto the head.

5. A polishing apparatus for polishing a polygonal substrate, the polishing apparatus comprising:

a table for holding a polishing pad; and a head for holding a polygonal substrate as a polishing object of a polishing apparatus, the head comprising:

a substrate holding surface for holding a substrate; and a retainer positioned outside the substrate holding surface, wherein the retainer has an end region, the end region is arranged adjacent to a corner portion of the substrate held onto the head, the end region has an end surface on a side of the substrate holding surface, and the end surface is configured to increase in distance from the substrate holding surface with approaching an end portion in a longitudinal direction of the retainer, wherein the end region of the retainer is configured such that the corner portion of the substrate does not contact the retainer even when the substrate rotates on the substrate holding surface, the end region of the retainer has a curved part, and the curved part of the retainer is arranged adjacent to the corner portion of the substrate held onto the head, the retainer further comprises a positioning feature for positioning the retainer inside the head, wherein the positioning feature is positioned in the curved part of the retainer, the polishing apparatus is configured to polish the substrate by pressing the substrate held onto the head to the polishing pad and relatively moving the substrate and the polishing pad.

6. A retainer used for a head for holding a polygonal substrate as a polishing object of a polishing apparatus, comprising:

an end region, the end region is arranged adjacent to a corner portion of the substrate held onto the head, the end region has an end surface on a side of the substrate, and the end surface is configured to increase in distance from the substrate with approaching an end portion in a longitudinal direction of the retainer, wherein the end region of the retainer is configured such that the corner portion of the substrate does not contact the retainer even when the substrate rotates in the head, the end region of the retainer has a curved part, and the curved part of the retainer is arranged adjacent to the corner portion of the substrate held onto the head, the retainer further comprises a positioning feature for positioning the retainer inside the head, wherein the positioning feature is positioned in the curved part of the retainer.

7. The retainer according to claim 6, wherein the retainer has a central region, and the end region of the retainer extends from the central region.

8. The retainer according to claim 7, wherein the central region of the retainer has a straight part, and the straight part of the retainer is arranged along a side of the substrate held onto the head.

9. A head for holding a polygonal substrate as a polishing object of a polishing apparatus, the head comprising:

a substrate holding surface for holding a substrate; and a retainer positioned outside the substrate holding surface, wherein the retainer has an end region, the end region is arranged adjacent to a corner portion of the substrate held onto the head, the end region has an end surface on a side of the substrate holding surface, and the end surface is configured to increase in distance from the substrate holding surface with approaching an end portion in a longitudinal direction of the retainer, wherein the end region of the retainer is configured such that the corner portion of the substrate does not contact the retainer even when the substrate rotates on the substrate holding surface, the retainer has a central region, and the end region of the retainer extends from the central region, the central region of the retainer has a straight part, and the straight part of the retainer is arranged along a side of the substrate held on the substrate holding surface of the head, the end region of the retainer has a straight part, the straight part of the central region and the straight part of the end region meet at an obtuse angle, the retainer further comprises a positioning feature for positioning the retainer inside the head, wherein the positioning feature is positioned in the end region of the retainer.

* * * * *